US008221851B2

(12) United States Patent
Zoppas et al.

(10) Patent No.: US 8,221,851 B2
(45) Date of Patent: Jul. 17, 2012

(54) PROCESS AND DEVICE FOR TREATING THE COATING OF THERMOPLASTIC RESIN CONTAINERS

(75) Inventors: Matteo Zoppas, Fontanafredda (IT); Alberto Armellin, Vittorio Veneto (IT); Andrea Saran, Tarzo (IT); Ottorino Vendramelli, San Vendemiano (IT)

(73) Assignee: S.I.P.A. Societa Industrializzazione Progettazione (IT)

( * ) Notice: Subject to any disclaimer, the term of this patent is extended or adjusted under 35 U.S.C. 154(b) by 0 days.

(21) Appl. No.: 13/089,022

(22) Filed: Apr. 18, 2011

(65) Prior Publication Data

US 2011/0262658 A1 Oct. 27, 2011

Related U.S. Application Data

(62) Division of application No. 10/527,225, filed as application No. PCT/EP2003/010040 on Sep. 10, 2003, now Pat. No. 7,926,197.

(30) Foreign Application Priority Data

Sep. 10, 2002 (IT) ..... RM02A0452

(51) Int. Cl.
*B05D 3/06* (2006.01)

(52) U.S. Cl. ..... 427/557; 427/372.2; 427/379; 34/266; 34/274; 34/502; 34/104; 432/21; 432/202; 118/641; 118/643

(58) Field of Classification Search ..... None
See application file for complete search history.

(56) References Cited

U.S. PATENT DOCUMENTS 3,270,710 A * 9/1966 Johnson et al. ..... 118/56
5,658,619 A * 8/1997 Kirschner et al. ..... 427/512

* cited by examiner

*Primary Examiner* — David Turocy
*Assistant Examiner* — Joel Horning
(74) *Attorney, Agent, or Firm* — Lorusso & Associates

(57) ABSTRACT

A process and device for drying the coating of containers made of thermoplastic material. The process involves feeding said containers through a furnace divided into two areas: in the first, most of the solvent of the coating is removed by heating the paint with infrared lamps, while the temperature of the containers is controlled through an airflow; in the second, the remaining solvent is removed using said airflow coming from the first area of the furnace.

19 Claims, 2 Drawing Sheets

PROCESS AND DEVICE FOR TREATING THE COATING OF THERMOPLASTIC RESIN CONTAINERS

CROSS-REFERENCE TO RELATED APPLICATIONS

This is a divisional application of U.S. application Ser. No. 10/527,225 filed Mar. 10, 2005, now U.S. Pat. No. 7,926,197 issued Apr. 19, 2011, which is a national stage application of International Application No. PCT/EP2003/010040 filed 10 Sep. 2003, which claims priority to Italian Patent Application No. RM02A000452 filed 10 Sep. 2002, the contents all of which are incorporated in their entirety herein by reference.

TECHNICAL FIELD

This invention relates to a process, and the relating device, for treating the coating of containers. More particularly, it relates to a process, and the relating device, for drying protective coatings on containers, especially bottles made of thermoplastic resin.

BACKGROUND ART

Thermoplastic materials, such as PET (polyethylene terephthalate), have been used for some time now to make containers. This is particularly true for food-containing containers, especially drinks. Although said containers can be of different types, they shall be referred to hereinafter generically as bottles, which happen to be the most spread.

Bottles made of thermoplastic materials are definitely convenient in terms of weight, resistance to impact, cost, and similar but also have some drawbacks. For example, said materials are somewhat microporous making, along with the limited thickness of the wall, the bottle permeable to gas. For example, oxygen may penetrate into the bottle modifying the contents through oxidation, and/or carbon dioxide found in many carbonated drinks may escape making the drink less fizzy and attractive.

Many solutions have been put forward to resolve these problems. Firstly, one solution involves increasing the thickness of the bottle wall; unfortunately, this increases production costs and can lead to problems during manufacturing. Secondly, one solution involves using multilayer bottles; however, this increases production costs and complexity. Thirdly, another solution entails depositing a thin layer to act as barrier on the internal wall of the bottles; unfortunately, this also increases costs and complexity.

An apparently simple and effective solution exists to the problem of creating a protective coating capable of acting as barrier to gas exchanges: painting, especially through dipping, the external surface of the bottles.

For example, U.S. Pat. No. 5,658,619 describes a process for coating bottles. This process involves sending bottles to a coating segment where the bottles are gripped and dipped one at a time in one of many containers filled with a coating solution consisting of a resin dispersed in a solvent. Then, after removing the bottles from the coating solution, the bottles are released and sent to a flash-off segment where the solvent of the coating solution is removed from the coating applied to the outer surface of the bottle. After the flash-off process, the bottles are sent to a reticulation station where the resin of the coating is reticulated.

Such a plant is complex and has a few critical points, especially regarding the formation of paint sagging in the detearing phase, during the transfer from the painting station to the flash-off station. Furthermore, eliminating the solvent found in the paint through simple flash-off is a long process that is not well controlled.

Sometimes paints with a water-based solvent are used to reduce costs and limit environmental pollution. Unfortunately, this option hampers drying, requiring long drying times or heating of the bottles at a temperature apt to promote the quick elimination of the solvent. If high outputs are required, said temperature is very near to, if not greater than, the temperature for softening the thermoplastic material of the bottles.

Hence, it is very important to provide a paint-drying system that limits any damage to the bottles and, at the same time, assures treatment methods and limited drying times, after painting, that prevent irregularities in the thickness of the coating.

A simple way of drying said water-based paints is to heat them; for example, by exposing them to infrared radiation (IR).

An infrared-heating plant is described, for example, in patent application PCT/EP00/10540, of this Applicant, although it refers to a plant for conditioning pre-moulded workpieces to be sent to final moulding, meaning that it is used to raise the temperature of said workpieces to one suitable for final moulding. In the aforementioned document, the pre-moulds are conveyed past a series of IR lamps; at the same time, an adjustable airflow at ambient temperature flows, first, around the pre-moulds and, then, around the IR lamps to cool them.

Although this solution is appealing, it concerns non-painted pre-moulds, which must simply be heated at an established temperature using different handling methods and short heating times.

OBJECTS OF THE INVENTION

It is an object of this invention to provide a process for drying perfectly a protective layer placed on containers, especially bottles, made of thermoplastic material in order to decrease the permeability of the bottle to gas, which could affect the quality of the contents of the bottle if gas seeps into or out of the bottle.

It is another object of the invention to provide a process for drying the protective layer placed on containers, especially bottles, made of thermoplastic material without overheating the thermoplastic material, which could distort the bottles, and wasting energy.

It is an additional object of the invention to provide a plant for carrying out the aforementioned process.

These and other advantages of the invention shall be readily apparent from the detailed description of the currently preferred embodiments of the invention, given as nonlimiting examples that do not exclude further embodiments and improvements.

DESCRIPTION OF THE INVENTION

This invention refers to a process whereby bottles, which are made of thermoplastic material and held by their aperture by means of evenly distributed specific gripping devices, are dipped into a resin solution in a solvent, which is later evaporated through the flash-off method, in order to place a protective layer on the outer surface of the bottles. The drying process described in this invention comprises the following steps:

i. Feeding the coated bottles, after removing the excess resin solution employing a known method, through a first area of the treatment furnace located under spaced out heating elements;

ii. Allowing air to flow from outside the treatment furnace into said first area of the furnace; specifically, the air must flow upward, first, around the bottles and, then, around said heating elements;

iii. Sending said bottles, after feeding them under the heating elements, into a second area of the furnace, which is located above said heating elements;

iv. Allowing the airflow, which has already flown around said heating elements, to flow around the bottles in said second area;

v. Mixing at least part of the hot airflow flowing out of said second area with air obtained from outside before sending a refreshed airflow to said first area of the furnace.

Inside the drying furnace, both in the first and second areas, the bottles are positioned horizontally.

The above process is further characterized by the fact that the radiation emitted upward by the heating elements is reflected on the bottles by means of a reflecting device. This reflecting device also lets the airflow that flowed past the heating elements into said second area; in fact, the device is suitably perforated uniformly on 10-30% of its surface (preferably, 15-25%).

The heating elements have an elongated shape and many infrared lamps (IR), preferably arranged in several distinct clusters. The major axis of these heating elements is positioned horizontally.

The temperature of the airflow that brushes against the bottles being fed under the heating elements ranges from 50 to 70° C., and the speed of the airflow flowing around the bottles is between 1.5 and 2.5 m/s; these parameters are controlled so that the temperature of the bottles passing beneath the heating elements is never greater than 65° C.

Then, the airflow, which has been warmed up (to reach a temperature approximately between 60 and 80° C.) by the heating elements, flows (at a speed ranging from 1.5 to 2.5 m/s) around the already treated bottles in the second area of the furnace above the heating elements so that the temperature of the bottles does not exceed 65° C.

The relevant parameters (power emitted by the lamps, airflow, bottle treatment time, and air circulation % in the furnace) are all adjusted so that 75 to 95% of the solvent (ideally 85 to 92%) is removed from the coating through infrared heating in the first area of the furnace, while the remaining amount of solvent is removed through hot air in the second area of the furnace.

In this manner, i.e. by removing only part of the solvent from the coating in the first area of the furnace, it is possible to control very well the temperature of the bottles under the heating elements, minimizing distortions of the bottle wall and resin crystallization.

As was already mentioned, the hot air coming from the first area of the furnace is utilized again in order to remove any residual solvent from the coating in the second area of the furnace, minimizing wasted energy. Furthermore, the air flowing out of said second area is sent back, at least partially, to the first area of the furnace; thus, not only does this further conserve energy but it also helps maintain the desired temperature in said first and second areas of the furnace, promoting excellent process steadiness regardless of ambient temperature.

In addition, part of the cold air drawn from outside the furnace is diverted, before entering the first area of the furnace, in order to maintain the neck of the bottles at a temperature of 55° C. at most.

The bottles are kept in the horizontal position throughout the drying process, and, at least in the infrared furnace, the bottles rotate at a speed between 100 and 300 revolutions per minute.

The infrared lamps are of the medium wave type; the time the bottles take to pass in front of the lamps is included between 15 and 30 sec, preferably 25 sec.

A particular embodiment of the invention shall be described below. This version is given as a nonlimiting example of the scope and scale of the invention, and in conjunction with the following accompanying drawings:

BRIEF DESCRIPTION OF THE DRAWINGS

FIG. 1 shows the basic cell of the plant in accordance with the invention.

Figure 1:
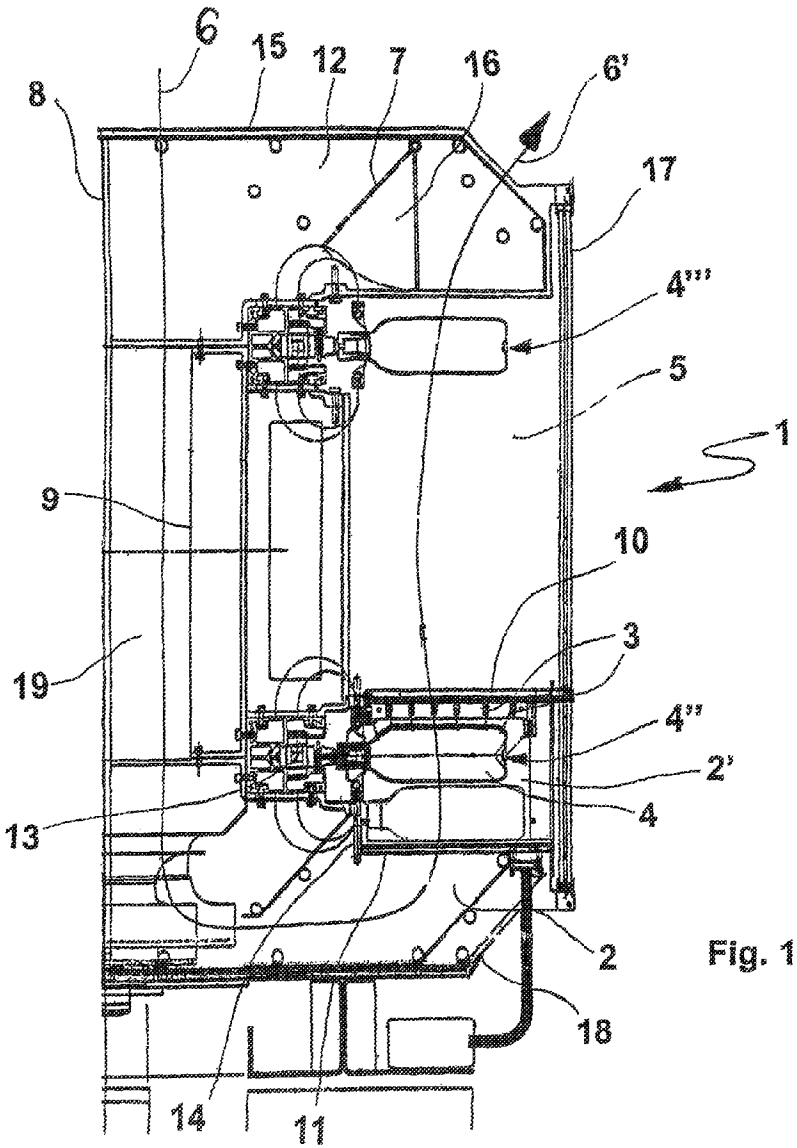
FIG. 1 shows a vertical cross section of a first embodiment of the plant.

It consists of a chamber (1) delimited by walls (8,15, 17, and 18), comprising the following elements:

i. A first lower area (2) for treating bottles (4), and a second upper area (5) for treating bottles ii. A furnace (2') found inside the lower area (2) equipped with heating elements (3) (for example, infrared lamps) suitable to emit thermal radiation; this furnace is delimited by a wall (14), part of the outer wall (17), an upper wall (10), and a lower wall (11)—both suitable to reflect the thermal radiation and allow gas to flow through;

iii. Known means (not shown in the figures) suitable to create a flow of ambient air (6) and to control the flow rate;

iv. A chamber (12) suitable to receive said airflow (6); this chamber is delimited by walls (8, 15) and by a door (7) communicating with a vertical duct (19), which is delimited by a wall (8) and an element (9) that in turn communicates with said lower area (2);

v. A chain having many gripping devices (13) that grip and hold the bottles, the so-called chucks, in the furnace (2'); said chain passes outside the furnace parallel to a wall (14) equipped with an opening apt to enable the passage of the neck of the bottles, making it possible to keep the neck of the bottles outside the furnace (2') and divide the airflow (6).

During the process, the bottles (4) enter the furnace (2') near the lamps in a specific position (position 4"), move through the entire furnace in said position, exit the furnace, move upward, and are placed in a specific position (4"). Meanwhile, an airflow (6), which is created and controlled, by devices not shown in the figure, flows from the chamber (12) into the lower area (2) through a duct (19). Once the airflow reaches said area, it is divided by a wall (14) into two parts: a first airflow goes through a wall (11) in order to enter the furnace (2'), control the temperature of the bottles, and cool the devices that emit thermal radiation or heating elements (3); a second airflow flows upward in order to exit the furnace (2') brushing against a wall (14) in order to keep the neck of the bottles (4) held in the chucks (13) cool.

The first part of the airflow, after cooling the heating elements (3), goes through a wall (10) and flows upward to the upper part of the chamber (1) where it brushes against the bottles in position 4''', finishing off the paint-drying process, and then flows into the escape chamber (16). In this chamber, the hot airflow is at least partially sent back into chamber 12 through a door (7) in order to regenerate heat and keep the temperature of the furnace (2') constant.

Figure 2:
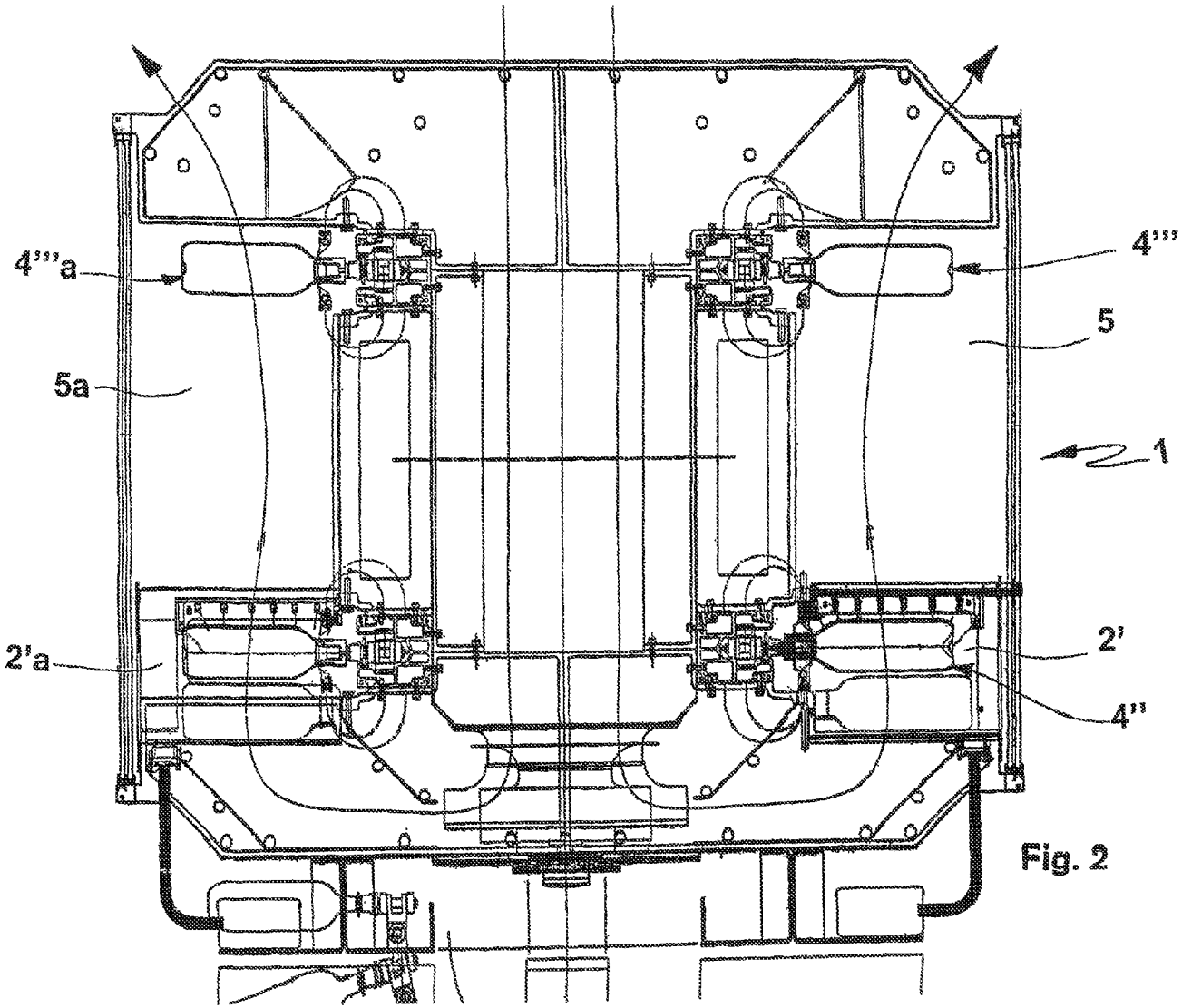
FIG. 2 shows a vertical cross section of a second embodiment of the plant.

If there is not enough space lengthwise to handle the required output, instead of the in-line layout, the two segments of the plant can be placed side by side (see FIG. 2 where all the parts are numbered exactly like in FIG. 1). In this version of the invention, the bottles move along the following path (refer to drawing): starting on the right-hand side, the bottles enter the chamber (1) in position 4", travel through the furnace (2') in the direction of the viewer, turn left to enter furnace 2'*a* on the left part of the plant moving away from the viewer; now, they move upward in position 4'''*a*, travel across the upper area (5*a*) of the left part of the plant moving toward the viewer again, turn right, and finally enter in position 4''' in part 5 that they travel across moving away from the viewer toward the exit of the drying plant.

The invention claimed is:

1. A process for treating in a treatment furnace the coating of bottles made of thermoplastic material coming from a plant where each bottle is held by its aperture by means of evenly distributed specific gripping devices moved by a conveyor chain, dipped into a resin solution in a solvent in order to create a protective and impermeable-to-gas layer on the outer surface of the bottle, excess paint is appropriately removed, and said solvent is evaporated, the drying process comprising the steps of:

i. Feeding the bottles through a first area of the treatment furnace located under spaced out heating elements;

ii. Providing an air flow from outside the treatment furnace into said first area of the furnace directed upwardly, first, around the bottles and, then, around said heating elements;

iii. Sending said bottles, after feeding them under the heating elements, into a second area of the furnace, which is located above said heating elements;

iv. Allowing the airflow, which has already flowed around said heating elements, to flow around the bottles in said second area;

v. Mixing at least part of the hot airflow flowing out of said second area with air obtained from outside before sending a refreshed airflow to said first area of the furnace.

2. The process of claim 1 wherein said heating elements consist of many infrared lamps (IR) of the medium wave type.

3. The process of claim 2 wherein said infrared lamps are arranged in several distinct clusters.

4. The process of claim 2 wherein the hot airflow exiting said second area after having completely dried the coating is recycled in the furnace of an amount comprised between 0 and 90%.

5. The process of claim 1 wherein the temperature of said airflow in said first area ranges from 50 to 70° C., while the speed of the airflow around the bottles is included between 1.5 and 2.5 m/min.

6. The process of claim 5 wherein said parameters are controlled by fittingly modifying the flow rate of the airflow coming from outside the plant and the amount of hot air coming from said second area, which is mixed with said airflow.

7. The process of claim 6 wherein the amount of time the bottles stay in front of the lamps is included between 15 and 30 sec.

8. The process of claim 6 wherein the amount of time the bottles stay in front of the lamps equals 25 sec.

9. The process of claim 1 wherein said airflow, which passing around the heating elements has reached a temperature between 60° C. and 80° C., meets, at a speed included between 1.5 and 2.5 m/s, in the second area of the furnace above the heating elements, the previously treated bottles and keeps them at a temperature lower than 65° C.

10. The process of claim 1 wherein power emitted by the lamps, airflow, bottle treatment time, and air circulation % in the furnace are all adjusted so that 75 to 95% of the solvent is removed from the coating in the first area of the furnace, while the remaining amount of solvent is removed in the second area of the furnace.

11. The process of claim 10 wherein the amount of solvent removed from the coating is included between 85 and 92%.

12. The process of claim 1 wherein the treatment furnace further comprises a wall having a slot adapted to allow the passage of the neck of the bottles, making it possible to keep the neck of the bottles outside the furnace and to divide the airflow.

13. A process for drying bottles made of thermoplastic material and having a coating comprising a resin solution and a solvent to create a protective and gas-impermeable layer, the drying process comprising:

a. Providing a treatment furnace having a first area and a second area wherein the treatment furnace includes spaced heating elements wherein the first area is positioned under the heating elements and wherein the second area is positioned above the heating elements;

b. Feeding the bottles through the first area of the treatment furnace under the heating elements;

c. Providing an airflow from outside the treatment furnace into the first area of the furnace whereby the airflow is directed upwardly around the bottles and thereafter around the heating elements to produce a hot airflow;

d. Transferring the bottles from the first area into the second area; and, e. Allowing the hot airflow that has previously flowed around the heating elements to flow around the bottles in the second area.

14. The process of claim 13 further comprising:

mixing at least part of the hot airflow flowing out of said second area with air obtained from outside before sending a refreshed airflow to said first area of the furnace.

15. The process of claim 13 further comprising:

heating the airflow and the bottles in the first area with the heating elements wherein the airflow becomes a hot airflow.

16. The process of claim 15 further comprising heating the bottles in the second area with the airflow that previously flowed around the heating elements.

17. The process of claim 16 further comprising:

providing the treatment furnace with a wall having a slot adapted to allow the passage of the neck of the bottles, making it possible to keep the neck of the bottles outside the furnace and to divide the airflow.

18. The process of claim 17 wherein said heating elements comprise a plurality of infrared lamps (IR) of the medium wave type.

19. The process of claim 13 further comprising:

providing a chain having a plurality of chucks for gripping and holding the bottles when in proximity of the treatment furnace and passing outside of the furnace parallels to a furnace wall provided with an opening adapted to allow the passage of the necks of the bottles, making it possible to keep the necks of the bottles outside the furnace and to divide the airflow.

* * * * *